US005337673A

United States Patent [19]

Koontz et al.

[11] Patent Number: 5,337,673

[45] Date of Patent: Aug. 16, 1994

[54] CONTROLLED FRAGMENTATION WARHEAD CASE

[75] Inventors: Robert A. Koontz; Kenneth R. Hayes, both of Ridgecrest, Calif.

[73] Assignee: The United States of America as represented by the Secretary of the Navy, Washington, D.C.

[21] Appl. No.: 169,442

[22] Filed: Dec. 17, 1993

[51] Int. Cl.[5] ..... F42B 12/24

[52] U.S. Cl. ..... 102/491; 102/389; 102/492; 102/493

[58] Field of Search ..... 102/491–497, 102/389

[56] References Cited

U.S. PATENT DOCUMENTS

| | | | |
|---|---|---|---|
| 174,771 | 3/1876 | Broadwell | 102/496 |
| 2,933,799 | 5/1957 | Semon | 29/1.21 |
| 3,799,054 | 3/1974 | LaRocca | 102/494 |

FOREIGN PATENT DOCUMENTS

| | | | |
|---|---|---|---|
| 73164 | 1/1894 | Fed. Rep. of Germany | 102/494 |
| 47256 | 4/1911 | Fed. Rep. of Germany | 102/494 |
| 2923877 | 12/1980 | Fed. Rep. of Germany | 102/495 |
| 491085 | 5/1919 | France | 102/493 |

*Primary Examiner*—Harold J. Tudor

*Attorney, Agent, or Firm*—John L. Forrest, Jr.; Melvin J. Sliwka; Robert J. Hampsch

[57] ABSTRACT

An improved method of producing a controlled fragmentation warhead case by embedding an expanded metal liner on the interior surface of a casing for a warhead or other ordnance device. The process of embedding an expanded metal liner into the casing during the forming of the casing produces a controlled fragmentation grid on the interior surface of the casing. The improved method of producing a controlled fragmentation warhead case is particularly suitable for weapon systems employing large, unitary warheads.

6 Claims, 1 Drawing Sheet

CONTROLLED FRAGMENTATION WARHEAD CASE

BACKGROUND OF THE INVENTION

The present invention generally relates to controlled fragmentation warheads and more particularly to an improved method for producing a controlled fragmentation warhead case. Specifically, the present invention provides a method of manufacturing a controlled fragmentation grid on the interior surface of a cylindrical casing used for a warhead or other ordnance device.

Existing methods for incorporating controlled fragmentation in warheads and other ordnance devices typically involve costly and lengthy processes. Alternative methods of producing controlled fragmentation warheads have been thoroughly investigated but have failed to develop a method which significantly reduces the time, cost, and simplifies the processing required to produce controlled fragmentation warheads.

A widely used method of producing controlled fragmentation warheads involves machining grooves on the interior surface of the casing. Machining individual casings, however, represents an additional step in the manufacturing process and thus represents a time consuming and relatively expensive method of incorporating controlled fragmentation.

Another particularly unique method of producing controlled fragmentation warheads is disclosed in U.S. Pat. No. 2,933,799. Such method involved forming spaced notches in a stock bar by a punch-pressing operation, winding the notched bar in a helix, and then welding adjacent turns of the helix with a continuous weld. The welded helix may then be cut in any desired lengths to form warheads of any desirable size.

Still another conventional method of fabricating controlled fragmentation warheads is by the process of casting the warheads in a casting form having a grooved pattern. Due to the time intervals involved in the casting operations, this method is impractical for mass production purposes since it requires numerous casting forms in order to compensate for the time loss in each casting form and a prohibitively large manufacturing plant to install the numerous casting forms required. Moreover, experience has shown that cast-produced warheads are unsatisfactory due to erratic fragmentation and due to pulverization into useless chaff of a substantial portion of the warhead.

Notwithstanding these related methods, there still exists a need to develop a lower cost method of producing controlled fragmentation warheads.

SUMMARY OF THE INVENTION

The general purpose of this invention is to provide a new and improved method of producing a controlled fragmentation warhead case. The preferred method is relatively fast, inexpensive and capable of being carried out in most manufacturing plants without requiring the installation of expensive equipment.

The present invention involves processing a preform cylindrical casing and a expanded metal liner in a drawing operation. Tooling required for such processing comprises: a punch, over which the materials are placed; a die through which the punch will draw the materials; and a press which provides the force required for the drawing operation.

Specifically, the present method of producing controlled fragmentation warheads comprises the steps of:

(a) placing an expanded metal liner inside a cylindrical metal preform; (b) placing the liner/preform assembly over the punch; activating the press to force the punch and liner/preform assembly through the die which embeds the expanded metal liner into the cylindrical metal preform while simultaneously thinning the cylindrical metal preform case and forming a controlled fragmentation grid on the interior surface of the newly created warhead casing.

Accordingly, it is an object of the present invention to provide a novel and inexpensive method of producing controlled fragmentation warheads.

Another object of the invention is to provide a method for producing a controlled fragmentation grid on the interior surface of a warhead casing capable of being practiced in many manufacturing installations.

A particular feature of the present invention is the use of expanded metal liners of differing hardness from the casting material.

An advantage of using the present invention on many warhead casing designs is that the present invention provides a means for improved fragmentation control and thus improved warhead performance as compared to many existing controlled fragmentation warheads.

Yet another advantage of using the present invention on many warhead casing designs is that the present invention provides a means for incorporating controlled fragmentation in casings concurrently with the casing formation.

The disclosed method for producing a controlled fragmentation warhead and controlled fragmentation grid on the interior surface of a casing of an ordnance device realizes the aforementioned objects, features, and advantages in a manner that is clearly evident from a thorough consideration of the figures and detailed description that follows.

BRIEF DESCRIPTION OF THE DRAWINGS

In the following detailed description, reference will be made to the attached drawings in which.

DETAILED DESCRIPTION OF THE INVENTION

Figure 1:
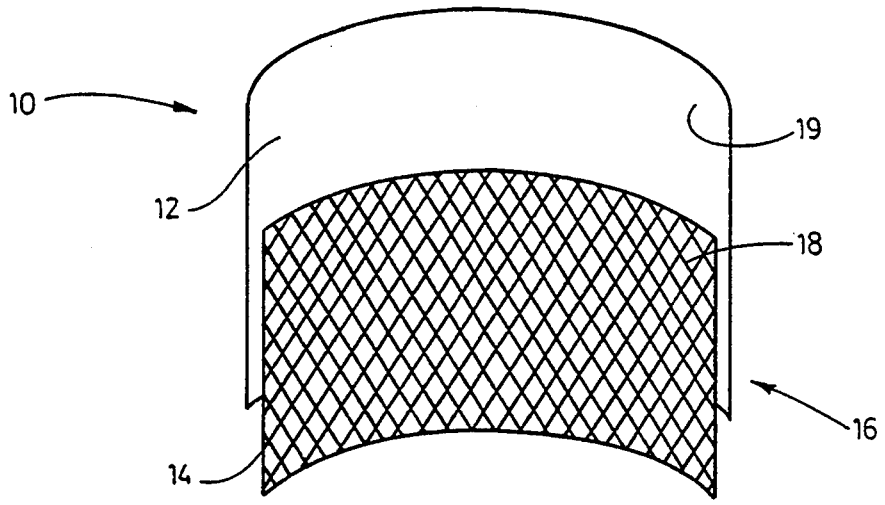
FIG. 1 shows a partial cross section view of the materials used in the present invention. Illustrated is the preform case together with the expanded metal liner forming the preform/expanded metal assembly.

Referring to FIG. 1, the preferred material utilized in this method of producing a controlled fragmentation warhead casing (10) comprises a cylindrical metal preform case (12), and an expanded metal liner (14). The expanded metal liner (14) is preferably cylindrical in shape which will facilitate the placement of the expanded metal liner (14) inside the cylindrical preform case (12). The dimensions of the cylindrical preform case (12) are driven by the end-item specifications for which the controlled fragmentation warhead case (10) is to be used. Likewise, the dimensions of the expanded metal liner (14) are also driven by the end-item specifications, but care must be taken to ensure the expanded metal liner (14) fits snugly into the cylindrical preform case (12) proximate the interior surface (19) of the preform case (12). The combination of the cylindrical preform case (12) with the expanded metal liner (14) inserted therein, is referred to as the preform/expanded metal assembly (16).

Expanded metal refers typically to sheet metal which has been stretched or expanded to form a screen, by first splitting the solid sheet intermittently so that the entire sheet has a series of closely spaced parallel cuts, to permit expanding it laterally. As the sheet is stretched edgewise the numerous slits open and the metal between them forms a screen having a diagonal pattern. The expanded metal liners can be made from stock of various thicknesses and can incorporate diagonal patterns of different dimensions.

Figure 2:
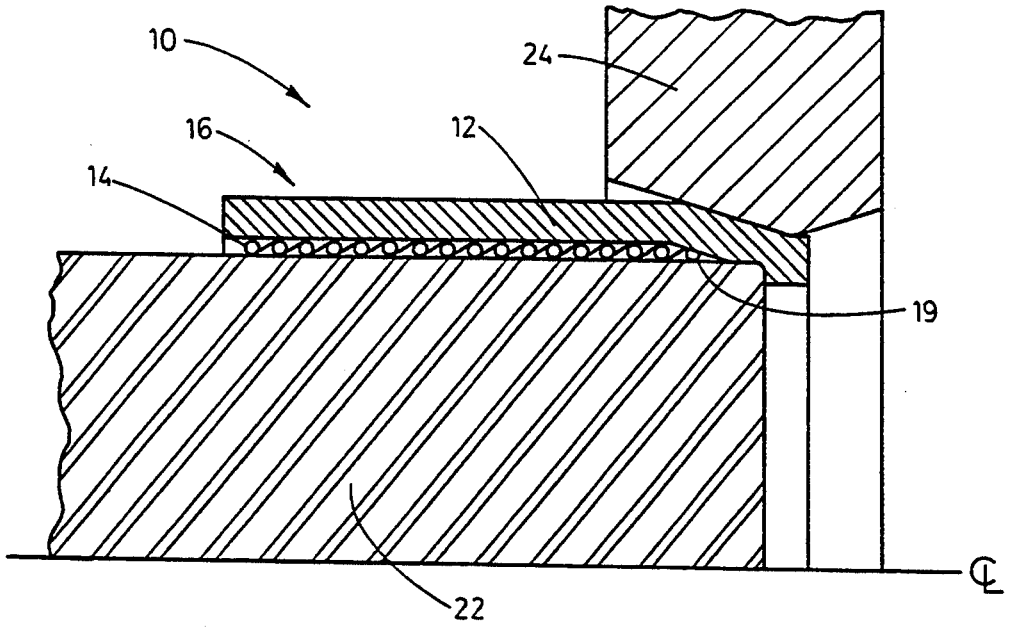
FIG. 2 is a partial cross section view of the tooling arrangement and materials used in the improved method of producing a controlled fragmentation warhead case.

Referring to FIG. 2, the tooling required for the improved method of producing controlled fragmentation warhead casings (10) as well as a controlled fragmentation grid (18) on the interior surface (19) of a warhead casing (10) consists of a punch (22), over which the preform/expanded metal assembly (16) is placed, a die (24) through which the punch (22) will draw the preform/expanded metal assembly (16) and a press (not shown) which provides the force required for the drawing operation. Associated hardware to support the tooling in the press and provide for stripping of the processed part is also required but is of a standard nature.

A partial view of the tooling arrangement and materials used in the process for manufacturing a controlled fragmentation grid (18) on the interior surface (19) of a cylindrical preform casing (12) is provided in FIG. 2. The expanded metal liner (14) is placed within the cylindrical preform case (12) forming a preform/expanded metal assembly (16). With the tooling mounted in the press (not shown), place the preform/expanded metal assembly (16) over the punch (22). Activate the press to force the punch (22) and preform/expanded metal assembly (16) through the die (24). The action of the punch (22) and preform/expanded metal assembly (16) moving through the die (24) embeds the expanded metal liner (14) in the preform case (12) and thins the preform case (12). Utilize the associated hardware to strip the newly formed controlled fragmentation warhead casing (10) off the punch (22).

Proper design of the tooling and the material to be processed must be exercised to ensure successful processing. The preform case (12) thickness and outside diameter must, along with the critical dimensions of the die (24), be appropriately designed so that after the drawing process is complete, the preform case (12) has thinned and the expanded metal liner (14) has been embedded into the preform case (12) thereby producing the controlled fragmentation warhead case (10). The actual percentages of the case thinning is variable, but the thinning must not be so excessive that either the preform case or the finished controlled fragmentation case fractures during the process.

In order to attain the proper embedding of the expanded metal liner (14) into the preform case (12), a differential hardness between the two materials is mandatory. The amount of differential hardness required is clearly dependent on the specific materials used as well as the design specifications of the controlled fragmentation warhead case (10). For a preform case (12) of annealed AISI 1026 (Rockwell 80) an expanded metal liner (14) of AISI 4130 (Rockwell C 28) was processed successfully.

From the foregoing, it is apparent that the present invention provides a novel and inexpensive method of producing a controlled fragmentation warhead case by embedding an expanded metal liner on the interior surface of a casing for a warhead or other ordnance device. The embedding process can be accomplished by any suitable means and preferably any mechanical means. It is also apparent that the materials, equipment and tooling involved in practicing the preferred method are such that the method may be carried out in most manufacturing installations without difficulty. Having described the invention in detail, those skilled in the art will appreciate that modification may be made to the invention without departing from its spirit, therefor it is not intended that the scope of the invention be limited to the specific embodiment illustrated and described. Rather, it is intended that the scope of this invention be determined by the appending claims and their equivalents.

What is claimed as the invention is:

1. A controlled fragmentation warhead case comprising:

a cylindrical metal case; and a cylindrical case liner made of expanded metal, the case liner being embedded in an interior surface of the metal case such that a controlled fragmentation grid is formed on the interior surface of the controlled fragmentation warhead case.

2. The controlled fragmentation warhead case of claim 1 wherein the controlled fragmentation grid is a diagonal pattern which is formed on the interior surface of the controlled fragmentation warhead case.

3. The controlled fragmentation warhead case of claim 1 wherein there is a differential hardness between the case liner and the metal case such that the case liner can be properly embedded in the metal case.

4. A controlled fragmentation warhead case comprising:

a cylindrical metal case; and an expanded sheet metal liner having a plurality of closely spaced parallel slits in a longitudinal direction prior to said liner being expanded thereby forming a metal screen having a generally diagonal pattern upon lateral expansion of the sheet metal liner, the expanded sheet metal liner further being embedded in an interior surface of the metal case such that a controlled fragmentation grid is formed on the interior surface of the controlled fragmentation warhead case.

5. The controlled fragmentation warhead case of claim 4 wherein the controlled fragmentation grid is a diagonal pattern which is formed on the interior surface of the controlled fragmentation warhead case.

6. The controlled fragmentation warhead case of claim 4 wherein there is a differential hardness between the sheet metal liner and the metal case such that the sheet metal liner can be properly embedded in the metal case.

* * * * *